US009144891B2

(12) United States Patent
Khangar et al.

(10) Patent No.: US 9,144,891 B2
(45) Date of Patent: Sep. 29, 2015

(54) NUTDRIVER

(71) Applicant: Milwaukee Electric Tool Corporation, Brookfield, WI (US)

(72) Inventors: Abhijeet A. Khangar, Waukesha, WI (US); Cheng Zhang Li, Sussex, WI (US); Wade F. Burch, Wauwatosa, WI (US); Michael S. Steele, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 246 days.

(21) Appl. No.: 13/827,019

(22) Filed: Mar. 14, 2013

(65) Prior Publication Data

US 2013/0239755 A1 Sep. 19, 2013

Related U.S. Application Data

(60) Provisional application No. 61/680,013, filed on Aug. 6, 2012, provisional application No. 61/625,241, filed on Apr. 17, 2012, provisional application No. 61/611,842, filed on Mar. 16, 2012.

(51) Int. Cl.

| | |
|---|---|
| ***B25B 13/06*** | (2006.01) |
| ***B25B 23/12*** | (2006.01) |
| ***B25B 13/48*** | (2006.01) |
| ***B25G 1/04*** | (2006.01) |

(52) U.S. Cl.

CPC ..... *B25B 13/06* (2013.01); *B25B 13/481* (2013.01); *B25B 23/12* (2013.01); *B25G 1/043* (2013.01)

(58) Field of Classification Search

CPC ..... B25G 1/005; B25G 1/08; B25G 1/085; B25G 1/105; B25B 13/06; B25B 15/02; B25B 23/12

USPC ..... 81/489, 490, 177.2, 436–439, 121.1, 81/124.3, 125

See application file for complete search history.

(56) References Cited

U.S. PATENT DOCUMENTS

| | | | | |
|---|---|---|---|---|
| 1,161,270 | A * | 11/1915 | Vance | 81/489 |
| 3,354,757 | A | 11/1967 | Grimm et al. | |
| 3,392,767 | A * | 7/1968 | Stillwagon, Jr. | 81/438 |

(Continued)

OTHER PUBLICATIONS

Navy, Wrenching Element, External Spline, Dimensions for (1991) MS33787 Rev-D, 2 pages.

(Continued)

*Primary Examiner* — Hadi Shakeri

(74) *Attorney, Agent, or Firm* — Michael Best & Friedrich LLP

(57) ABSTRACT

A nutdriver that includes a socket configured to receive and engage a hex nut to rotate the hex nut relative to a threaded rod. The socket includes a socket opening. The nutdriver further includes a shank including a first end, a second end, and a shank aperture that extends through the first end and the second end of the shank. The nutdriver further includes a handle including a front end, a back end, and a handle aperture that extends through the front end and the back end of the handle, and the second end of the shank is coupled to the handle for co-rotation. The socket opening, the shank aperture, and the handle aperture are aligned and in communication to allow the threaded rod to extend through the socket opening, the shank aperture, the handle aperture, and beyond the back end of the handle while the socket rotates the hex nut.

17 Claims, 4 Drawing Sheets

(56) References Cited

U.S. PATENT DOCUMENTS

| | | | | |
|---|---|---|---|---|
| 3,913,427 | A | 10/1975 | Brase | |
| 4,048,875 | A | 9/1977 | Heinen et al. | |
| 4,307,634 | A | 12/1981 | Gentry | |
| 4,594,874 | A * | 6/1986 | Bononi et al. | 72/356 |
| 4,924,733 | A * | 5/1990 | McKenzie | 81/438 |
| 5,341,707 | A | 8/1994 | Bond | |
| 5,615,587 | A | 4/1997 | Foerster, Jr. | |
| 6,154,108 | A * | 11/2000 | Huang | 81/125 |
| 6,330,844 | B1 | 12/2001 | Walker | |
| 6,374,709 | B1 * | 4/2002 | Vasichek et al. | 81/125 |
| 6,865,971 | B2 * | 3/2005 | Ernesti | 81/124.3 |
| 7,246,540 | B2 | 7/2007 | Rillera | |
| 7,743,684 | B2 | 6/2010 | Guile et al. | |
| D706,596 | S * | 6/2014 | Moore, Jr. | D8/21 |
| 2008/0196562 | A1 * | 8/2008 | Elliston et al. | 81/433 |
| 2009/0178517 | A1 * | 7/2009 | Forrester | 81/124.2 |
| 2011/0048175 | A1 | 3/2011 | LeVert | |
| 2011/0146834 | A1 | 6/2011 | McDonald et al. | |

OTHER PUBLICATIONS

ASME International, Nutdrivers (2004) B107.12-2004, 12 pages.

U.S. Department of Defense, Military Specification Sheet (1989) MIL-W-8982/1A, 6 pages.

* cited by examiner

NUTDRIVER

CROSS-REFERENCE TO RELATED APPLICATIONS

This application claims priority to U.S. Provisional Patent Application No. 61/680,013, filed Aug. 6, 2012, and to U.S. Provisional Patent Application No. 61/625,241, filed Apr. 17, 2012, and to U.S. Provisional Patent Application No. 61/611,842, filed Mar. 16, 2012, the entire contents of which are hereby incorporated by reference herein.

BACKGROUND

The present invention relates to fastener driver hand tools, and more particularly to nutdrivers.

Nutdrivers typically include a shaft with a handgrip at one end and a socket permanently fixed to the shaft at the other end of the shaft. The socket is typically a 6-point socket, which is configured to drive a hex head bolt or hex nut. The handle is a screwdriver-type handle. The user grips the handle to rotate the shaft and socket in order to rotate a nut or bolt that is received in the socket.

SUMMARY

In one embodiment, the invention provides a nutdriver configured to rotate a hex nut along a threaded rod. The nutdriver includes a socket configured to receive and engage the hex nut to rotate the hex nut relative to the threaded rod. The socket includes a socket opening that extends through the socket. The nutdriver further includes a shank including a first end, a second end, and a shank aperture that extends through the first end and the second end of the shank. The first end of the shank is coupled to the socket for co-rotation. The nutdriver further includes a handle including a front end, a back end, and a handle aperture that extends through the front end and the back end of the handle, and the second end of the shank is coupled to the handle for co-rotation. The socket opening, the shank aperture, and the handle aperture are aligned and in communication to allow the threaded rod to extend through the socket opening, the shank aperture, the handle aperture, and beyond the back end of the handle while the socket rotates the hex nut.

In another embodiment, the invention provides a nutdriver configured to rotate a nut along a fastener. The nutdriver includes a drive configured to receive and engage the nut to rotate the nut relative to the fastener, the drive including a drive opening that extends through the drive. The nutdriver further includes a shank including a first end, a second end, and a shank aperture that extends through the first end and the second end of the shank, the first end of the shank coupled to the drive for co-rotation. The nut driver further includes a handle including a front end, a back end, and a handle aperture that extends through a front end and the back end of the handle, and the second end of the shank is coupled to the handle for co-rotation. A sleeve is located within the handle aperture. The drive opening, the shank aperture, and the handle aperture are aligned and in communication to allow the fastener to extend through the drive opening, the shank aperture, the handle aperture, and beyond the back end of the handle while the drive rotates the nut. The second end of the shank is located within the handle aperture between the front end of the handle and the back end of the handle and the handle surrounds a portion of the shank.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
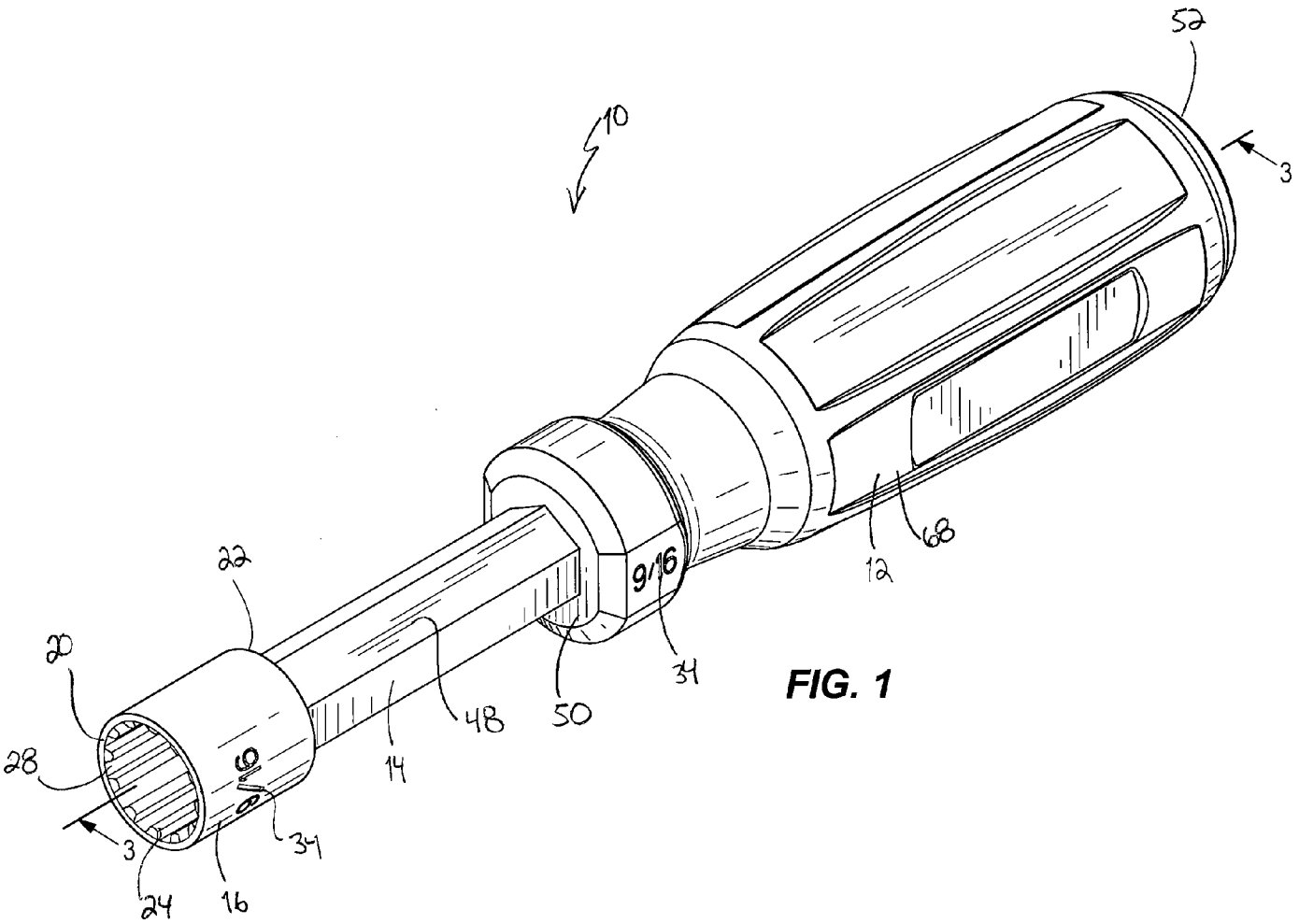
FIG. 1 is a perspective view of a nutdriver according to one embodiment of the invention.
Figure 2:
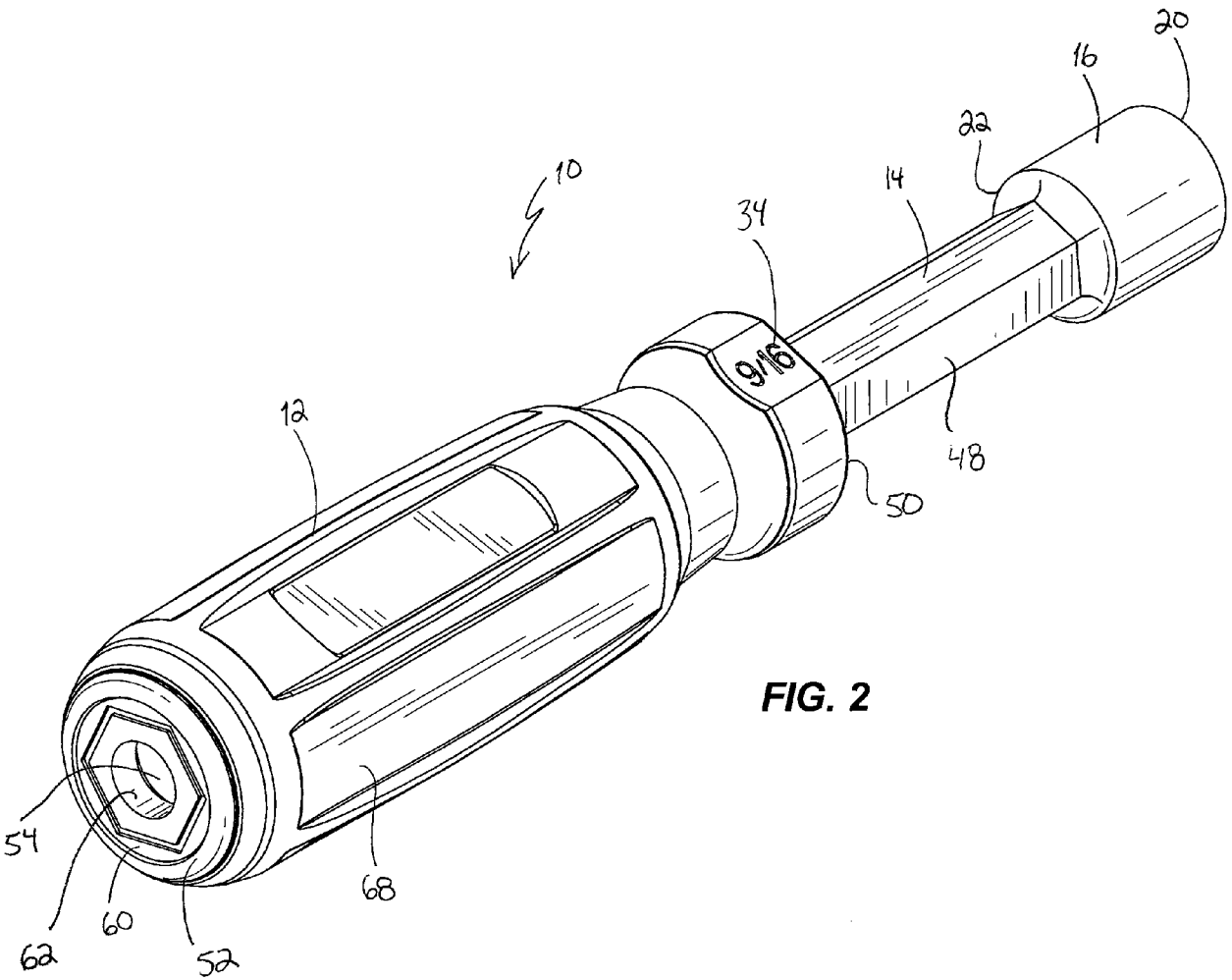
FIG. 2 is another perspective view of the nutdriver driver of FIG. 1.
Figure 3:
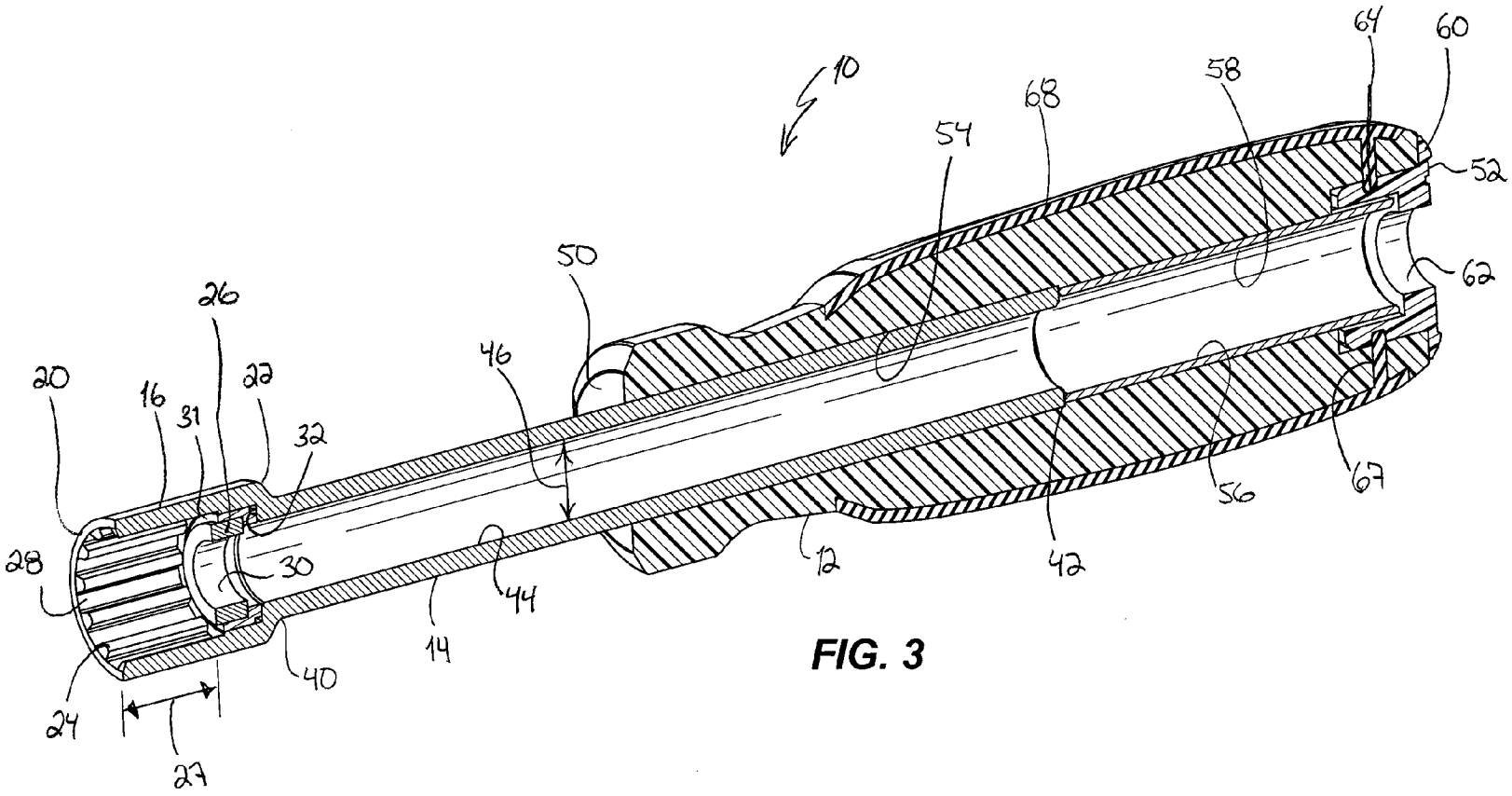
FIG. 3 is a cross-sectional view of the nutdriver driver of FIG. 1 taken along lines 3-3 of FIG. 1.

FIG. 1 illustrates a fastener driver 10, which is a nutdriver in the illustrated embodiment. The illustrated driver 10 includes a handle 12, a shank 14, and a drive 16. Referring to FIGS. 1 and 3, the drive 16 includes a front end 20 and a back end 22. A driver engaging portion 24 of the drive 16 is located adjacent the front end 20 and a magnet 26 is located adjacent the back end 22, that is between the back end 22 and the driver engaging portion 24. In the illustrated embodiment, the drive 16 is a socket and the driver engaging portion 24 includes twelve points or teeth such that the socket is a twelve point spline socket configured to engage and rotate a hex-nut, square nut, or a spline drive. The driver engaging portion 24 includes a length 27 that is defined by a length of the teeth in the illustrated embodiment. In other embodiments, other types of sockets, such as an eight point spline socket, a four point spline socket, a hex-shaped socket or a square socket or drive can be utilized.

The drive 16 further includes an opening or aperture 28 that extends through the front end 20 and the back end 22 of the drive 16. The illustrated magnet 26 is generally cylindrical and includes an aperture 30 that is concentric with the aperture 28 of the drive 16. The magnet 26 is retained in the aperture 28 to prevent the magnet 26 from falling through the aperture 28 and through the front end 20 and the back end 22 of the drive 16. In the illustrated embodiment, the magnet 26 is press fit into a sleeve 31, and the sleeve 31 is press fit into the aperture 28 to retain the magnet 26 in position. In the illustrated embodiment, a ledge 32 is located adjacent the back end 22 of the drive 16 to prevent the magnet 26 and the sleeve 31 from traveling through the back end 22 of the drive 16. In other embodiments, the magnet 26 can be held in position against the ledge 32 by an adhesive, weld, clips, fasteners, friction fit, and the like without the use of the sleeve 31.

In the illustrated embodiment, the drive 16 is integrally formed as a single component with the shank 14. In other embodiments, the drive is separately formed from the shank and permanently attached, such as by welding. In yet other embodiments, the drive is removably coupled to the shank so that the drive can be removed and replaced with a drive sized to rotate a different sized fastener. For example, the illustrated drive 16 is configured to rotate a 9/16 inch hex-nut, as indicated by indicia 34 on the handle 12 and the shank 14. In embodiments where the drive is removably coupled to the shank, drives sized to rotate other sizes of nuts, such as ½ inch, ¾ inch, and the like are provided which can be removably coupled to the shank. In other embodiments, the indicia for indicating the size of the drive can include colored rings on the handle 12 or the shank 14 that distinguish different sizes of the drive.

With continued reference to FIG. 3, the shank 14 includes a first or front end 40 and a second or back end 42. An aperture 44 having a diameter 46 extends through the front end 40 and the back end 42 of the shank 14. The aperture 44 of the shank 14 is connected to the aperture 28 of the drive 16 (i.e., the aperture 44 is in fluid communication with the aperture 28). In the illustrated embodiment, the shank 14 includes a generally hex-shaped outer surface 48 (FIG. 1). The hex-shaped outer surface 48 allows the shank 14 and the drive 16 to be rotated with a wrench, pliers, or the like to produce more torque than could typically be generated by a user manually rotating the handle 12.

Referring to FIGS. 1 and 3, the handle 12 includes a front end 50 and a back end 52. An aperture 54 extends through the handle 12 and through the front end 50 and the back end 52. The aperture 54 is sized to receive the shank 14 to couple the shank 14 to the handle 12. The handle 12 is coupled to the shank 14 such that the shank 14 and the handle 12 are coupled for co-rotation and the shank 14 is generally fixed from movement with respect to the handle 12. In one embodiment, the handle 12 is molded over the shank 14 by a suitable process such as injection molding In the illustrated embodiment, the back end 42 of the shank 14 is between the front end 50 and the back end 52 of the handle 12. In other embodiments, the shank extends all the way through the aperture 54 from the front end 50 of the handle 12 to the back end 52 of the handle 12. In one such embodiment, the back end 42 of the shank 14 is flush with the back end 52 of the handle 12, but in other embodiments, the shank 14 may extend past the back end 52 of the handle 12 such that the back end of the shank is located outside of the aperture 54. In one embodiment, the handle 12 is formed from plastic and the shank 14 is formed from metal. In the embodiment discussed above where the shank 14 extends at least until the back end 42 of the handle 12, the shank 14 inhibits contact between a threaded rod 72 (FIG. 4) and the handle 12 and the shank 14 inhibits the threaded rod 72 from damaging and wearing the plastic handle 12 during use of the driver 10.

Referring to FIG. 3, a sleeve 56, which is formed from metal in one embodiment, is located within the aperture 54 adjacent the back end 52 of the handle 12. The sleeve 56 abuts the back end 42 of the shank 14 and extends from the shank 14 toward the back end 52 of the handle 12. In one embodiment, the handle 12 is formed from plastic. In the embodiment illustrated in FIG. 3, the sleeve 56 inhibits contact between the threaded rod 72 (FIG. 4) and the handle 12, particularly adjacent the back end 52 of the handle 12, and the sleeve 56 inhibits the threaded rod 72 from damaging and wearing the plastic handle 12 during use of the driver 10. In one embodiment, the sleeve 56 is pressed into the aperture 54 from the back end 52 of the handle 12 until the sleeve 56 abuts the shank 14. An aperture 58 extends through the sleeve. A cap 60 is positioned over the back end 52 of the handle 12 to prevent the sleeve 56 from backing out of the aperture 54. The cap 60 includes an aperture 62 and a circumferential groove 64 that engages with a corresponding projection 67 of the handle 12. The cap may further include indicia as previously described with regard to the fastener driver 10 or may be dyed, painted, or colored to correspond with a particular characteristic of the fastener driver 10 (e.g., size).

The handle 12 further includes an overmold 68 formed from an elastomeric material, such as rubber. The overmold 68, in one embodiment, is injection molded around the handle 12 and the cap 60. The injection molding process creates the projection 67 of the overmold 68 that engages the groove 64 of the cap 60 to retain the cap 60 in the desired position.

Figure 4:
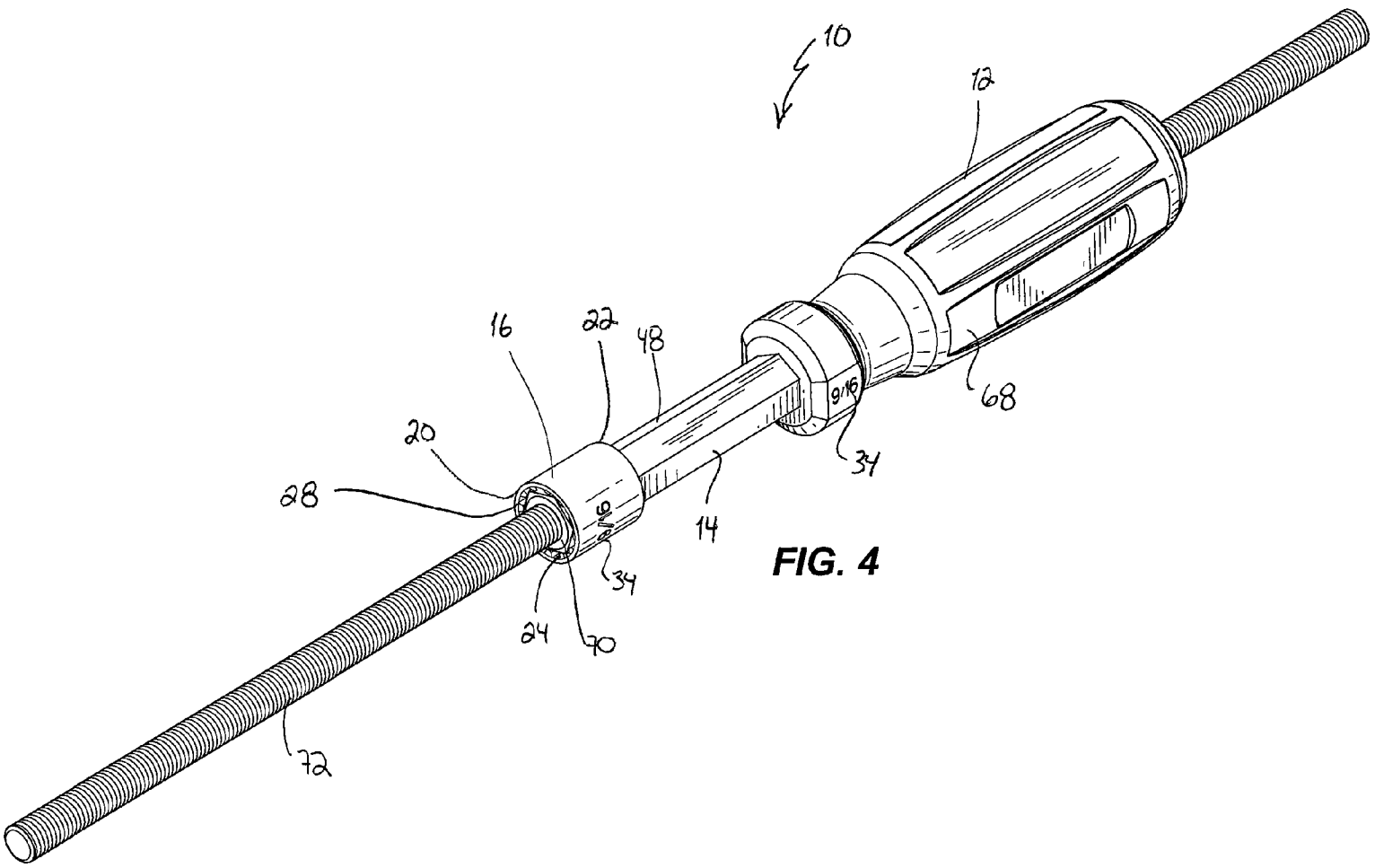
FIG. 4 is a perspective view of the nutdriver driver of FIG. 1 being used to position a fastener along a structural support.

In operation, referring to FIGS. 3-4, the driver 10 is used to position a fastener 70, which is a hex-nut in the illustrated embodiment, at a desired position along another fastener 72, which is the threaded rod 72 in the illustrated embodiment. For example, in one application, the fastener 70 is used to fasten a structural support, such as a Unistrut support, at a location along the rod 72 and the structural support can support a cable tray or the like. To position the fastener 70, the user inserts the fastener 70 into the drive 16. The magnet 26 retains the fastener 70 in the aperture 28 of the drive 16 against the force of gravity to inhibit the fastener 70 from falling out of the drive 16. Then, the user inserts the rod 72 through the fastener 70 and the user rotates the driver 10 relative to the rod 72 via the handle 12. The apertures 28, 44, 58, and 62 allow the rod 72 to pass through the driver 10 and through the back end 52 of the handle 12 so that the driver 10 can be used to position the fastener 70 on the relatively long rod 72. When the fastener 70 is in the desired position, the user can use the handle 12 or a wrench or pliers gripping the outer surface 48 of the shank 14 to finally position the fastener 70 or apply a final torque to the fastener 70 to secure the fastener 70 against the structural support.

Referring to FIG. 3, in the illustrated embodiment, the driver engaging portion 24 has the length 27 (i.e., depth). In one embodiment, the length 27 is long enough so that the driver engaging portion 24 can also drive or rotate a second fastener along with the first fastener 70. Therefore, the user can quickly position two fasteners 70 at a desired position along the rod 72. For example, there are standard dimensions for fasteners, such as nuts. In one embodiment, the driver engaging portion 24 has the length 27 that is approximately 1.5 times the standard width of the fastener 70. For example, in the illustrated embodiment, the drive 16 is sized to rotate a 9/16 inch nut and a 9/16 inch nut typically has a standard width (i.e., American Society of Mechanical Engineering Standard). The length 27 for the 9/16 inch driver is sized to provide at least about 10 percent engagement with a second fastener. Likewise, if the drive is sized to rotate a ¾ inch nut, the ¾ inch nut typically has standard width, greater than the standard width of a 9/16 inch nut, and the engagement depth for the ¾ inch driver is sized to provide at least about 10 percent engagement with the second fastener. Therefore, a drive configured for a ¾ inch nut would have a length of the driver engaging portion that is greater than the length 27 of the driver engaging portion 24 for the 9/16 inch drive.

Thus, the invention provides, among other things, a fastener driver that quickly moves one or more fasteners along a relatively long threaded rod, to position the fastener on the rod and torque the fastener.

Various features and advantages of the invention are set forth in the following claims.

What is claimed is:

1. A nutdriver configured to rotate a hex nut along a threaded rod, the nutdriver comprising:

a socket configured to receive and engage the hex nut to rotate the hex nut relative to the threaded rod, the socket including a socket opening that extends through the socket;

a shank including a first end, a second end, and a shank aperture that extends through the first end and the second end of the shank, the first end of the shank coupled to the socket for co-rotation;

a handle including a front end, a back end, and a handle aperture that extends through the front end and the back end of the handle, the second end of the shank coupled to the handle for co-rotation; and a sleeve located within the handle aperture, wherein the socket opening, the shank aperture, and the handle aperture are aligned and in communication to allow the threaded rod to extend through the socket opening, the shank aperture, the handle aperture, and beyond the back end of the handle while the socket rotates the hex nut, wherein the second end of the shank is located within the handle aperture between the front end of the handle and the back end of the handle and the handle surrounds a portion of the shank, and wherein the sleeve abuts the second end of the shank and extends from the second end of the shank toward the back end of the handle.

2. The nutdriver of claim 1, further comprising a cap that defines the back end of the handle, wherein the cap retains the sleeve within the handle aperture.

3. The nutdriver of claim 2, wherein the handle includes an overmold that couples the cap to the handle.

4. The nutdriver of claim 1, wherein the handle is at least partially formed from an elastomeric material.

5. The nutdriver of claim 1, wherein the socket is a twelve point socket.

6. The nutdriver of claim 1, wherein the socket is integrally formed as a single component with the shank.

7. The nutdriver of claim 1, further comprising an annular magnet located within the socket opening and configured to retain the hex nut within the socket opening.

8. The nutdriver of claim 1, wherein the shank includes a hexagonal shaped outer surface.

9. The nutdriver of claim 1, wherein the handle includes indicia that indicates a size of the socket.

10. A nutdriver configured to rotate a nut along a fastener, the nutdriver comprising:

a drive configured to receive and engage the nut to rotate the nut relative to the fastener, the drive including a drive opening that extends through the drive;

a shank including a first end, a second end, and a shank aperture that extends through the first end and the second end of the shank, the first end of the shank coupled to the drive for co-rotation;

a handle including a front end, a back end, and a handle aperture that extends through the front end and the back end of the handle, the second end of the shank coupled to the handle for co-rotation; and a sleeve located within the handle aperture, wherein the drive opening, the shank aperture, and the handle aperture are aligned and in communication to allow the fastener to extend through the drive opening, the shank aperture, the handle aperture, and beyond the back end of the handle while the drive rotates the nut, wherein the second end of the shank is located within the handle aperture between the front end of the handle and the back end of the handle and the handle surrounds a portion of the shank, and wherein the sleeve abuts the second end of the shank and extends from the second end of the shank toward the back end of the handle.

11. The nutdriver of claim 10, further comprising a cap that defines the back end of the handle, wherein the cap retains the sleeve within the handle aperture.

12. The nutdriver of claim 11, wherein the handle includes an overmold that couples the cap to the handle.

13. The nutdriver of claim 10, wherein the drive is a socket drive.

14. The nutdriver of claim 10, wherein the drive is integrally formed as a single component with the shank.

15. The nutdriver of claim 10, further comprising an annular magnet located within the drive opening and configured to retain the hex nut within the drive opening.

16. The nutdriver of claim 10, wherein the shank includes a hexagonal shaped outer surface.

17. A nutdriver configured to rotate a hex nut along a threaded rod, the nutdriver comprising:

a socket configured to receive and engage the hex nut to rotate the hex nut relative to the threaded rod, the socket including a socket opening that extends through the socket;

a shank including a first end, a second end, and a shank aperture that extends through the first end and the second end of the shank, the first end of the shank coupled to the socket for co-rotation;

a handle including a front end, a back end, and a handle aperture that extends through the front end and the back end of the handle, the second end of the shank coupled to the handle for co-rotation; and a sleeve located within the handle aperture, wherein the socket opening, the shank aperture, and the handle aperture are aligned and in communication to allow the threaded rod to extend through the socket opening, the shank aperture, the handle aperture, and beyond the back end of the handle while the socket rotates the hex nut, wherein an annular magnet is located within the socket opening and configured to retain the hex nut within the socket opening, and wherein the sleeve abuts the second end of the shank and extends from the second end of the shank toward the back end of the handle.

* * * * *